United States Patent [19]

Stahlecker

[11] Patent Number: 4,607,485

[45] Date of Patent: Aug. 26, 1986

[54] FEED ARRANGEMENT FOR AN OPEN-END FRICTION SPINNING MACHINE

[75] Inventor: Fritz Stahlecker, Joseph-Neidhart-Strasse 18, 7347 Bad Überkingen, Fed. Rep. of Germany

[73] Assignees: Fritz Stahlecker; Hans Stahlecker, both of Fed. Rep. of Germany

[21] Appl. No.: 694,853

[22] Filed: Jan. 25, 1985

[30] Foreign Application Priority Data

Jan. 26, 1984 [DE] Fed. Rep. of Germany ..... 3402566

[51] Int. Cl.[4] ..... D01H 7/888; D01H 7/898

[52] U.S. Cl. ..... 57/401; 57/408; 57/411; 57/413

[58] Field of Search ..... 57/301, 400, 401, 408, 57/412, 413, 404, 411, 415

[56] References Cited

U.S. PATENT DOCUMENTS 3,777,466 12/1973 Kabele et al. ..... 57/408 X
4,249,370 2/1981 Vecera et al. ..... 57/301
4,467,597 8/1984 Parker et al. ..... 57/401
4,514,974 5/1985 Stahlecker ..... 57/401

FOREIGN PATENT DOCUMENTS 2812471 3/1978 Fed. Rep. of Germany .
2943063 6/1979 Fed. Rep. of Germany .

*Primary Examiner*—Donald Watkins
*Attorney, Agent, or Firm*—Barnes & Thornburg

[57] ABSTRACT

In the case of a device for open-end friction spinning having two friction rollers that are arranged next to one another to form a wedge-shaped gap and are drivable in the same rotational direction, an arrangement is provided for the feeding and opening of a sliver which contains an opening roller from which a fiber feeding duct leads to the wedge-shaped gap. A compressed air duct that is led past the opening roller is connected to the fiber feeding duct for supporting the fiber transport. A dirt discharge opening assigned to the circumference of the opening roller is arranged at a distance to the compressed air duct in such a way that the effect of the excess pressure does not reach back into the area of the dirt discharge opening.

22 Claims, 5 Drawing Figures

FEED ARRANGEMENT FOR AN OPEN-END FRICTION SPINNING MACHINE

BACKGROUND AND SUMMARY OF THE INVENTION

This invention relates to a feed arrangement for open-end friction spinning machines of the type having two friction rollers that are arranged next to one another to form a wedge-shaped gap serving as a yarn forming region or point. The friction rollers are drivable in the same rotational direction. A feeding and opening device is also provided that has an opening roller surrounded by a housing having a discharge opening for contaminants/dirt. The arrangement also has a fiber feeding duct starting approximatley tangentially at the opening roller and leading to the wedge-shaped gap. A suction device is provided for holding the fibers and the forming yarn in the wedge-shaped gap and a yarn withdrawal device is provided for withdrawing the yarn in the longitudinal direction of the wedge-shaped gap.

In the case of the arrangement of the initally mentioned type, such as disclosed in German Published Unexamined Patent Application (DE-OS) 29 43 063, the fiber transport from the opening roller to the wedge-shaped gap is caused essentially by the vacuum generated in the area of the wedge-shaped gap. Since the wedge-shaped gap is also open at different points with respect to the atmosphere for generating the air currents required for the spinning, relatively high suction air current must be taken in requiring a high air capacity installation. This high demand for air can create problems with respect to the cost effectiveness of a machine composed of a plurality of such arrangements.

In order to improve the fiber feeding from the opening roller to the wedge-shaped gap and make it more uniform, it is also know from German Published Unexamined Patent Application (DE-OS) 28 12 471 to subject the area of the opening roller to overpressure. In order to avoid a feedback of this overpressure in the area of the fiber material to be fed, in the case of this construction, the whole feeding and opening device is subjected to overpressure. This results in considerable costs with respect to construction but also in the fact that it is no longer possible to provide a discharge opening in the area of the circumference of the opening roller through which dirt and impurities contained in the fiber material are discharged.

The invention has the objective of improving an arrangement of the initially mentioned type by providing that the volume of air required for the air currents in the area of the wedge-shaped gap can be reduced, while still maintaining a perfect, and if possible, improved fiber transport between the opening roller and the wedge-shaped gap.

This objective is achieved by connecting to the fiber feeding duct in the area of the circumference of the opening roller a compressed air duct aimed into the fiber feeding duct, and by arranging the discharge opening in the transport direction of the fibers at a distance in front of the compressed air duct.

In the case of this development, the two systems of different air currents, namely the area of the discharge opening and the area of the fiber feeding duct, are separated from one another with respect to space. The compressed air duct aimed into the fiber feeding duct causes, or at least supports, the transport of the fibers to the wedge-shaped gap so that the required capacity installed for the suction device in the area of the wedge-shaped gap can be reduced. The additional costs of construction are minimal. In particular, it is also possible to utilize the compressed air created when the vacuum flow in the area of the wedge-shaped gap is generated for the area of the compressed air duct.

In a further development of the invention, it is provided that the compressed air duct is arranged approximately tangentially with respect to the opening roller as an extension of the fiber feeding duct. The jet of compressed air flowing out of the compressed air duct will then be directed in such a way that the possibility of a feedback to the area of the discharge opening for impurities is reduced further. In order to reduce this feedback still further, it is provided in a further development of the invention that the opening roller in the area between the discharge opening and the compressed air duct is covered by a wall piece that is adapted to its contour and serves as a screen. The length of this wall piece must be adapted to the technical spinning conditions and perhaps also to the resulting varying pressure values of the compressed air of the compressed air duct which can be determined by means of simple tests. The sealing effect may also be improved by providing the wall piece with at least one longitudinal groove extending in the axial direction of the opening roller. As a result, a type of labyringth seal is created in the area of the wall piece.

In a further development of the invention, it is provided that the compressed air duct is divided into several small ducts which, with their own mouths, lead into the fiber feeding duct. As a result, the compressed air flow can be made more uniform or may also be distributed differently in a manner that is especially desirable and advantageous for the opening and the transport of the fibers.

In a further development of the invention, it is provided that the fiber feeding duct is divided into at least two partial ducts to which, in each case, its own compressed air duct is assigned. As a result, the flow in the fiber feeding duct, and thus the fiber transport, can be made more uniform and can be proportioned as desired. By selecting the pressures in the individual ducts and thus of the air currents in the individual partial ducts of the fiber feeding duct, an adaptation to varying spinning conditions can be achieved.

Further objects, features, and advantages of the present invention will become more apparent from the following description when taken with the accompanying drawings which show, for purposes of illustration only, embodiments in accordance with the present invention.

Figure 1:
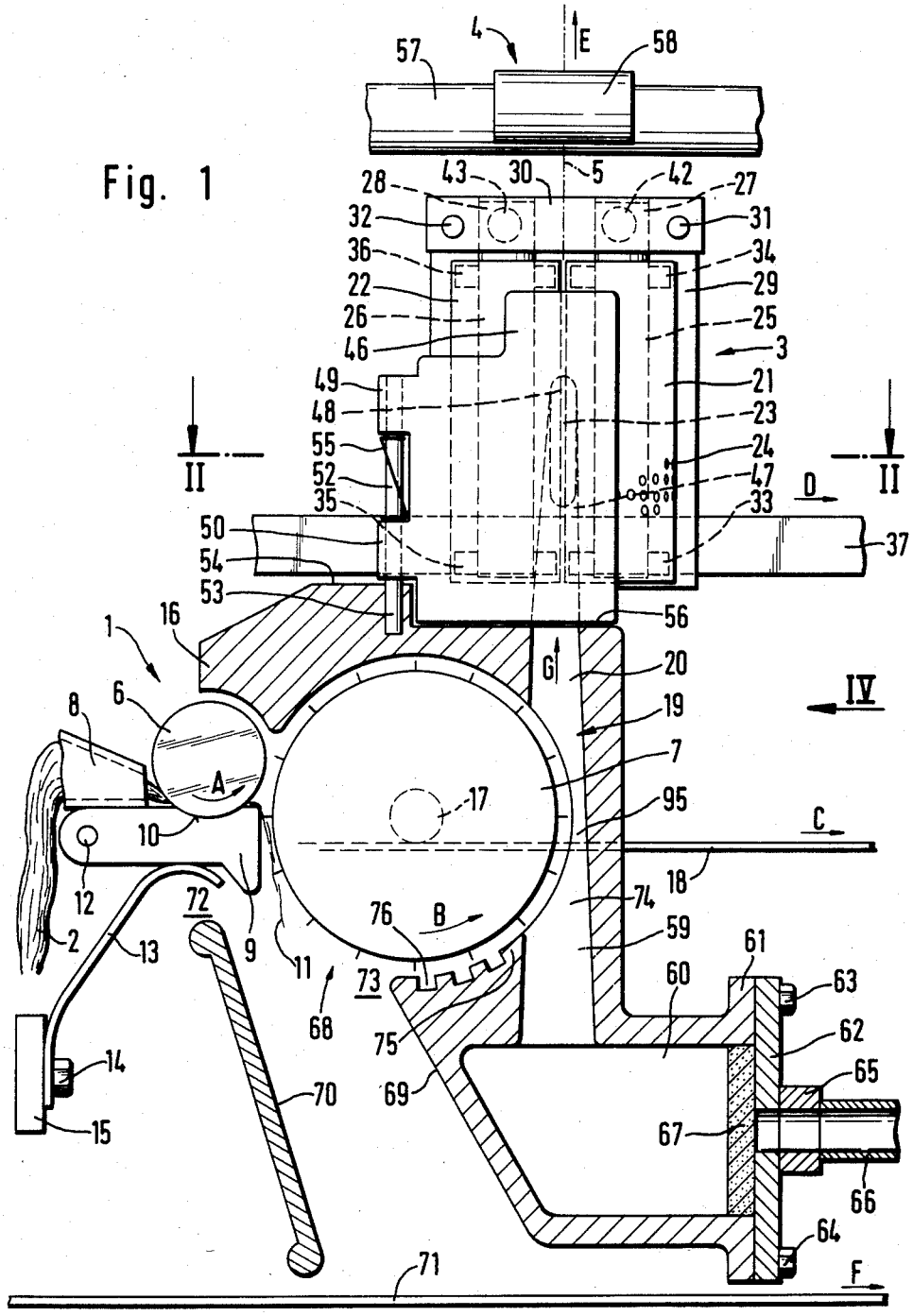
FIG. 1 is a partial sectional schematic of a friction spinning unit arrangement constructed according to a preferred embodiment of the invention, viewed from the operating side of the spinning unit.
Figure 5:
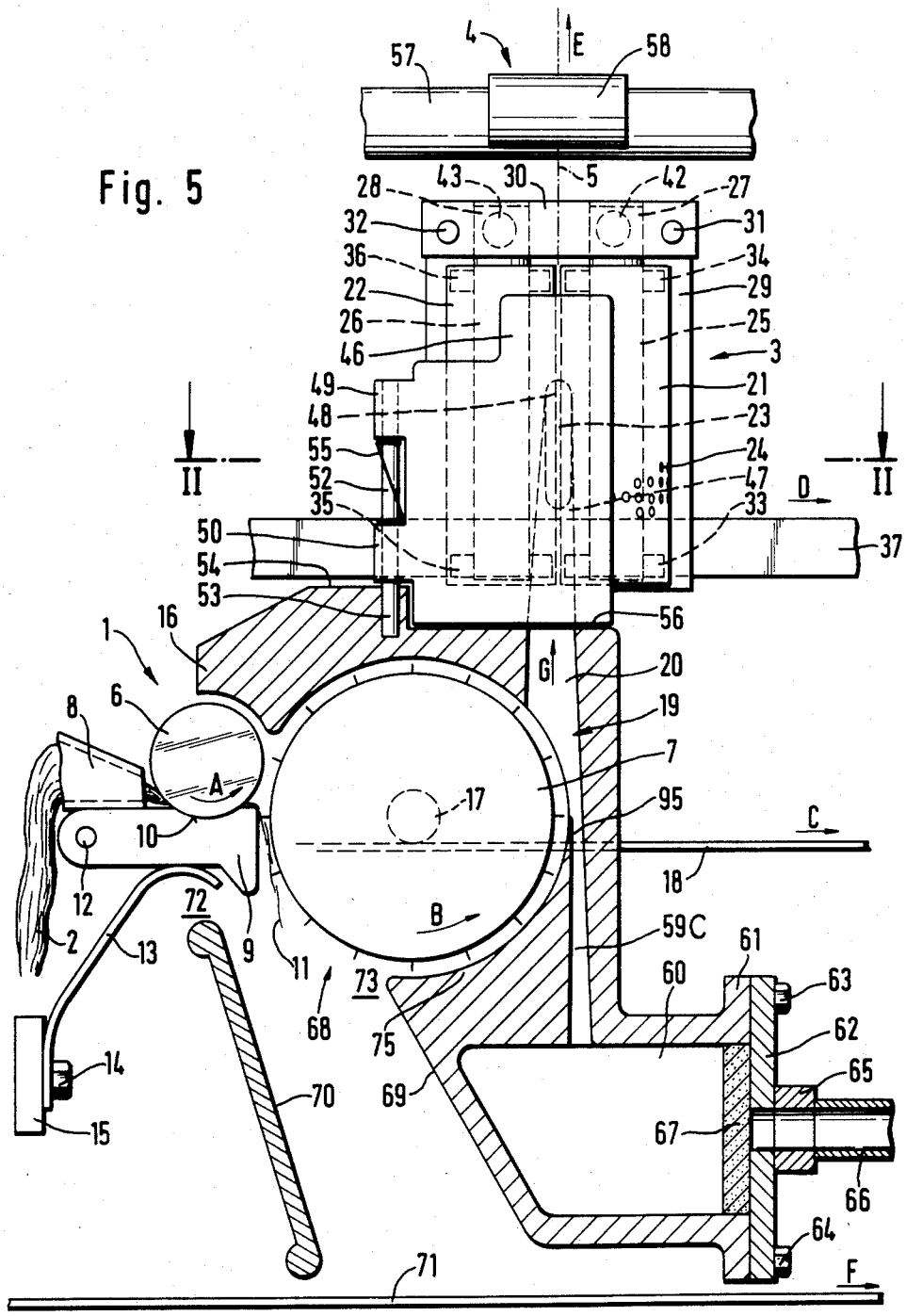

1), where the overpressure duct as well as the fiber feeding duct are divided into several ducts, constructed in accordance with certain other preferred embodiments of the invention;

FIG. 5 is a view similar to FIG. 1, showing another preferred embodiment of the invention where the compressed air duct is developed as an ejector.

DETAILED DESCRIPTION OF THE DRAWINGS

Figure 2:
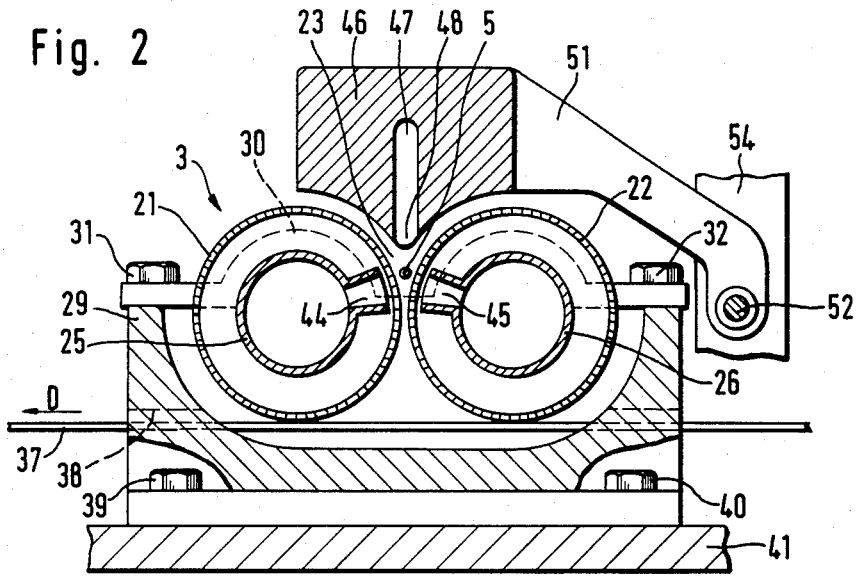
FIG. 2 is a slightly enlarged sectional view taken along Line II—II of FIG. 1.

The arrangement for open-end friction spinning according to FIG. 1 and 2 has a feeding and opening device 1 for a sliver 2 to be spun, devices 3 for providing a twist, i.e., for twisting the individual fibers together into a yarn 5, and a withdrawal device 4 for the spun yarn 5.

The feeding and opening device 1 contains a feeding roller 6 to which a feeding hopper 8 is connected that is sloped off toward the operating side of the arrangement. The sliver 2 is introduced into the feeding hopper 8 and is pulled in by the feeding roller 6 interacting with a feeding table 9. The feeding table 9 that can be pivoted around a pivotal shaft 12 is pressed by means of a leaf spring 13 against the feeding roller 6 rotating in the direction of Arrow A, the feeding table 9 forming a nip 10 with said feeding roller 6. The leaf spring 13 is fastened at a stationary holder 15 by means of a screw 14.

The sliver 2 transported by the feeding roller 5 and the feeding table 9 is offered to an opening roller 7 in the form of a fiber beard 11, the shaft of the opening roller 7 extending in parallel to the feeding roller 6. The opening roller 7 which is housed in an opening roller housing 16, in a manner that is not shown in detail, is provided at its circumference between two marginal webs with a set of needles or teeth. The opening roller 7 which is driven by means of a tangential belt 18 via its shank 17, turns in the same rotational direction (direction of Arrow B) as the feeding roller 5, but with a circumferential speed that is much higher. The tangential belt 18 runs through in the direction of the Arrow C in the longitudinal direction of a spinning machine composed of a plurality of such spinning units and drives the opening rollers 7 of all these spinning units. The opening roller 7, with its set of teeth or needles, combs out the fiber beard and separates the sliver into individual fibers in the process. After about 180° travel along the circumference of the opening roller 7, the individual fibers are taken off the circumference or the opening roller 7 and are transported via a fiber feeding duct 19 to the device 3. The first section 20 of the fiber feeding duct 19 extending approximately tangentially to the opening roller 7 is worked/formed into the opening roller housing 16 surrounding the opening roller 7.

The device 3 for providing the twist is formed by two friction rollers 21 and 22 that are arranged closely next to one another and in parallel to one another to form a wedge-shaped gap 23 serving as a yarn forming point or region where the individual fibers are collected and twisted together into the yarn 5. The friction rollers 21 and 22 that are provided with perforations 24 are each disposed directly on suction pipes 25 and 26 by means of roller bearings 33, 34 and 35, 36. The suction pipes 25 and 26 project with their ends 27 and 28 in the upward direction beyond the end faces of the rollers 21 and 22 and are fastened at a roller housing 29. The roller housing 29 has two bowl-shaped recesses for the suction pipes 25 and 26 which are clamped down by means of a tool holder 30 also having bowl-shaped recesses and being fastened by means of screws 31 and 32 at the roller housing 29.

The drive of the rollers 21 and 22 takes place by means of a tangential belt 37 running directly against their shell or cover surfaces, said tangential belt 37 being arranged in the area facing away from the tool holder 30. This tangential belt 37 extends in the direction of the Arrow D in the longitudinal direction of the spinning machine and is used for driving the rollers 21 and 22 of all spinning units of at least one side of the machine. The roller housing 29 (see FIG. 4 also) is provided with a recess 38 in the area in which the tangential belt 37 is moving. The roller housing 29 is fastened at a support 41 of the spinning machine by means of screws 39 and 40.

The suction pipes 25 and 26 that are closed on the front side have cross bores 42 and 43 in the area of their ends 27 and 28. Ducts of vacuum pipes that are led through the roller housing 29 are connected to bores 42. The suction pipes 25 and 26 are provided with longitudinal slots 44 and 45 in the area between the roller bearings 33, 34 and 35, 36, which slots are aimed at the area of the wedge-shaped gap 23 and are delimited by marginal webs reaching up to close to the inside surfaces of the shell surfaces of the rollers 21 and 22. By means of the vacuum generated via the suction pipes 25 and 26 in the area of the wedge-shaped gap 23, an air current is created flowing into the wedge-shaped gap 23 by means of which the fed fibers and the forming yarn are held in the wedge-shaped gap 23.

The area of the wedge-shaped gap 23 is covered by a pivotal housing part 46 which contains the second section 47 and the mouth 48 of the fiber feeding duct 19. The mouth 48 of the fiber feeding duct 19 extends in a straight line in the plane of the wedge-shaped gap 23, in a slot-shaped manner, and extends in the longitudinal direction of the wedge-shaped gap 23 and at a narrow distance from it.

The housing part 46 is provided with a lever-type projection 51 which can be pivoted by means of hinges 49 and 50 around a pivot shaft 52 extending in parallel to the rollers 21 and 22. The pivot shaft 52 is fastened with its end 53 in a projection 54 of the opening roller housing 16. By pivoting the housing part 46 to the operating side, the wedge-shaped gap 23 and the largest part of the surfaces of the rollers 21 and 22 can be exposed for maintenance purposes. In this process, the mouth 48 of the fiber feeding duct 19 as well as the individual sections 20 and 47 of the fiber feeding duct 19 also become accessible for servicing or monitoring purposes. A closing spring 55 is provided in the area of the pivot shaft 52 for holding the housing part 46 toward the closed position. The opening roller housing 16 and the housing part 46, in the area of the transition between the sections 20 and 47 of the fiber feeding duct 19, have plane surfaces 56 extending in a radial plane with respect to the pivot shaft 52, in the area of which a sealing takes place.

A drivable bottom roller 57 serves as the withdrawal device 4, this bottom roller 57 running through in the longitudinal direction of the machine, a pressure roller 58 being assigned to it at each spinning unit. The withdrawal device 4 is arranged above the rollers 21 and 22 in such a way that the spun yarn 5 is withdrawn in the longitudinal direction of the wedge-shaped gap 23 in the direction of the Arrow E. The yarn 5 is then directed to a winding device that is not shown and is wound onto a spool.

In the area of the transition 95 of the opening roller 7 to the fiber feeding duct 19, a compressed air duct 59 is connected to this fiber feeding duct 19, this compressed air duct 59 being arranged disposed as an extension of the fiber feeding duct 19 at the sides opposite the transport direction G of the fibers. An excess pressure chamber 60 is connected to the compressed air duct 59, said excess pressure chamber 60 being covered by a lid 62 which is fastened by means of screws 63 and 64 at a flange of the opening roller housing 16. The lid 62 is provided with a connecting piece 65 for a compressed air pipe 66 which is connected to a blower that is not shown. In preferred embodiments pipe 66 is attached to the delivery side of the blower that generates the vacuum in the suction pipes 25 and 26. A compensating insert 67 is arranged at the inlet into the excess pressure chamber 60 which in exemplary preferred embodiments include sintered metal, such as pearl bronze, or of another filter material and which is used for damping and making more uniform the flow of the fed compressed air. The fibers that are taken off the opening roller 7 at point 95 by means of the compressed air current are transported in the fiber feeding duct 19 to its mouth 48. The suction air flow aimed into the wedge-shaped gap 23 does not have to take any considerable part in this transport. This suction air flow can therefore be shaped by the special shaping of the housing part 46 in order to hold the fibers and the forming yarn in the wedge-shaped gap 23. The air volume that is required for the suction air flow may thus also be reduced considerably.

The quantity of air fed via the compressed air duct 59 should be approximately in the magnitude of the quantity that is sucked into the wedge-shaped gap 23 by both suction pipes 25 and 26. The speed of the compressed air flow coming out of the compressed air duct 59 should be in the magnitude of the circumferential speed of the set of the opening roller 7.

In the opening roller housing 16, a discharge opening 68 is provided in the area of the fiber beard 11 connecting to a cleated front of the feeding table 9. In a known manner, impurities contained in the fiber material are discharged through said discharge opening 68 during the combing-out of the fiber beard 11. Guide surfaces 69 and 70 are connected to the dirt discharge opening 68 which, together with lateral guide surfaces, direct the discharged impurities to a dirt transport belt 71 running in the direction of the Arrow F through the spinning machine and carrying away the discharged impurities.

It is necessary that in proximity of the circumference of the opening roller 7 in the area of the dirt discharge opening 68, neutral air conditions exist, or better yet, an at least minimal air flow in the direction of the opening roller 7 exists so that the fibers which, because of their ability to be suspended were separated from the inpurities, are not also discharged but remain in the circumferential area of the opening roller 7. This means that it is advantageous that a vacuum exists in the area 72 below the feeding table 9 as well as in the area 73 in the proximity of the end of the dirt discharge opening 68. In order not to disturb these areas 72 and 73 by the excess pressure generated through the compressed air duct 59 in the area 74, the discharge opening 68 is separated from the compressed air duct via a wall piece 75 that is closesly adapted to the contour of the opening roller 7, said wall piece 75 having the effect of a screen between the various pressure areas 72 and 73, on the one hand, and 74. In order to be able to reduce the length of the housing wall 75, it is advantageous to provide several grooves 76 in it that extend axially to the opening roller 7 so that a type of labyrinth sealing is provided.

Figure 3:
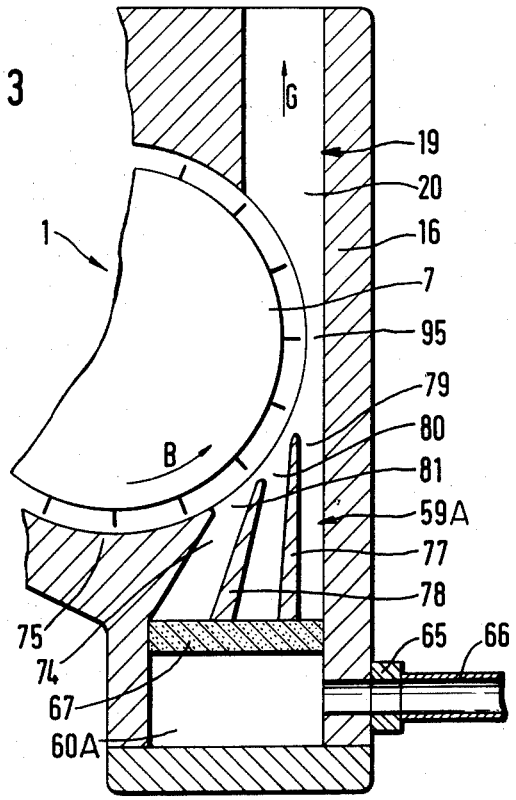
FIG. 3 is a detail schematic sectional view of an arrangement that is similar to that of FIG. 1, where the compressed air duct is divided into several ducts following one another in circumferental direction, constructed according to certain preferred embodiments of the invention.

In the case of the embodiment according to FIG. 3, which otherwise with respect to the elements that are not shown corresponds to the embodiment according to FIG. 1, the compressed air duct 59A is divided into three individual ducts 79, 80, and 81. These ducts 79, 80 and 81 which, like the compressed air duct 59 according to FIG. 1, extend approximately over the operating width of the opening roller 7, start in a joint exess pressure chamber 60A to which a compressed air pipe 66 is connected. The ducts 79, 80 and 81 are divided by separating walls 77 and 78 which start at a compensating insert 67.

As shown in FIG. 3, the mouths of the ducts 79, 80 and 81 are located one behind the other in circumferential direction of the opening roller 7. They are, in each case, directed approximately tangentially to the opening roller 7 so that only channel 79 extends as a straight extension of the fiber feeding duct 19, while the two other ducts 80 and 81 are directed correspondingly diagonally to the fiber feeding duct 19. For example, by dividing the compensating insert 67, it is possible to generate varying compressed air flows in ducts 79, 80 and 81. In this case, the speeds of the compressed air flows in ducts 80 and 81 should not exceed the circumferential speed of the opening roller 7. The flow velocity in duct 79, the exiting air current of which is led tangentially on the outside past the set of the opening roller 7, on the other hand, may be clearly higher. For this duct 79, a relatively high air current may be selected which may clearly be higher than the circumferential speed of the opening roller 7 without creating the danger that this high air current will move the fibers back into the set of needles or teeth and that they may possible be caught at this set. The air current in duct 79 which flows past the opening roller 7 outside its set of teeth or needles, causes an ejector effect by means of which the detaching of the fibers from the set of the opening roller 7 is facilitated. In addition, this further reduces a feedback of the excess pressure in area 74 to the area of the discharge opening 68 that is located in front of it in the transport direction of the fibers.

In certain contemplated embodiments it may also be sufficient to provide only duct 79 with an increased air flow and to do without ducts 80 and 81. By means of this mentioned ejector effect, an air current is then created in the area of the wall piece 75 in rotating direction of the opening roller 7 so that an additional sealing is no longer absolutely necessary.

Figure 4:
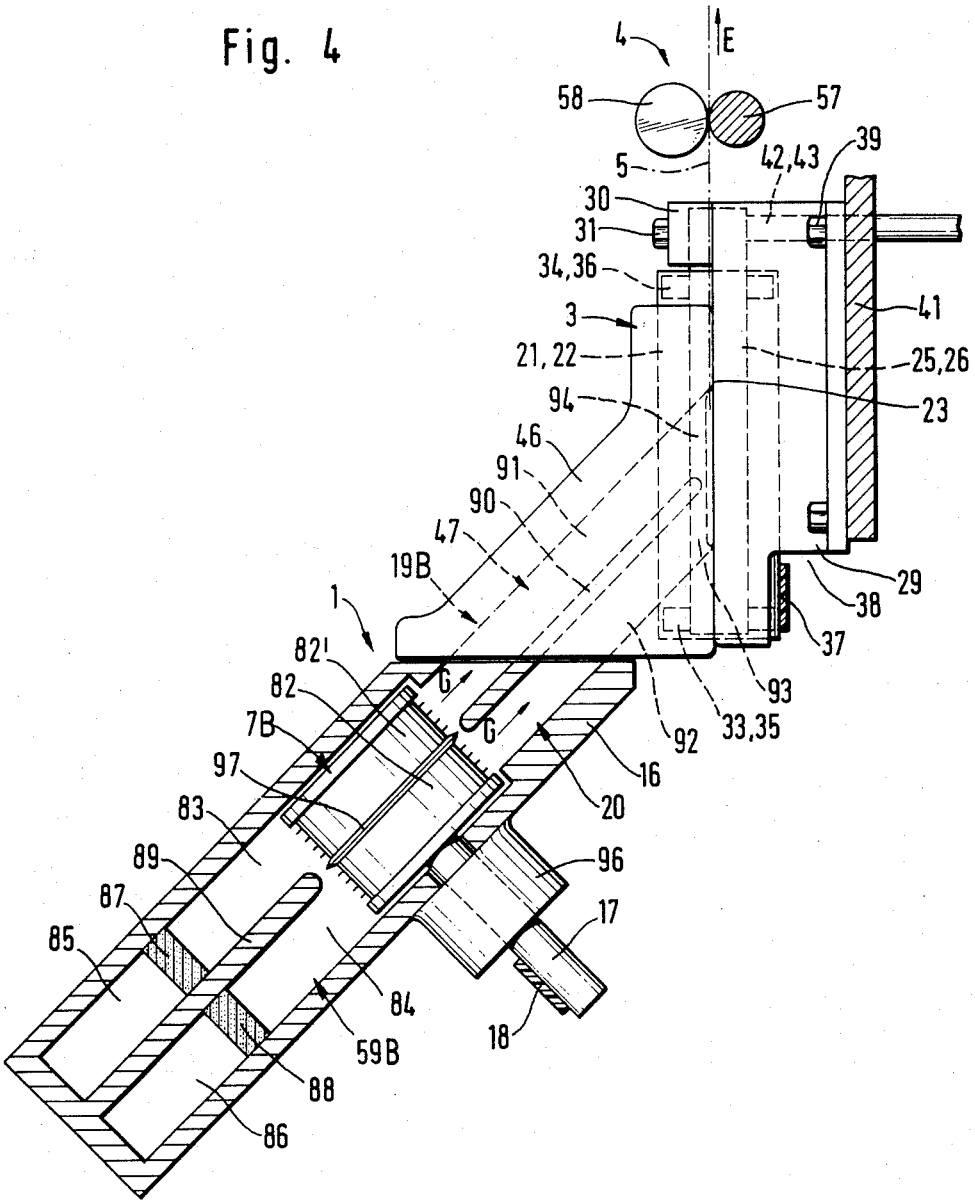
FIG. 4 is a partial sectional view of an arrangement that is similar to FIG. 1 (viewing direction IV of FIG.

In the case of the embodiment according to FIG. 4, the opening roller 7B is divided into two operating areas 82 and 82' that are located axially behind one another by means of a ring collar 97. In the operating areas 82 and 82', slivers made of varying fiber material may be fed to the opening roller 7 or a one-piece fiber beard can be divided by means of the ring collar 97. Corresponding to the operating areas 82 and 82', the fiber feeding duct 19B is divided into two partial ducts 91 and 92 by means of a separating wall 90. The air flow and thus the flowing fibers (direction of the Arrows G) are thus, in the fiber feeding duct 19B, divided into corresponding partial flows. As shown in FIG. 4, the separation into two partial ducts 91 and 92 takes place into the mouth area so that the fibers fed via the partial duct 92 are located more on the inside of the forming yarn 5 and the fibers fed via the partial duct 91 are located more in the cover of the yarn.

As also shown in FIG. 4, the compressed air duct 59B corresponding to the opening roller 7B is also divided into two ducts 83 and 84 which, with their own mouths, are opposite the partial ducts 91 and 92. Through the interposition of compensating inserts 87 and 88, the ducts 83 and 84 are in each case connected to their own excess pressure chambers 85 and 86 which themselves are connected to compressed air connections that are not shown. This makes it possible to admit compressed air flows of different strengths also to ducts 83 and 84 so that also the strength of the air current in partial ducts 91 and 92 can be controlled to a varying degree.

In its basic structure, the embodiment according to FIG. 5 corresponds to the embodiment according to FIG. 1. In contrast to FIG. 1, the compressed air duct 59C is developed in such a way that it acts as an ejector.

The mouth of the compressed air duct 59C that is located approximately on a radial with respect to the shaft of the opening roller 7 is located outside the cylinder surface enclosing the points of the set of the opening roller 7. The compressed air current coming out of the compressed air duct 59 aimed tangentially with respect to the opening roller 7 consequently is approximately tangentially led past the set of the opening roller 7. This compressed air jet may have a considerably higher velocity than the circumferential speed of the opening roller 7 and its set of teeth or needles. Because of the ejector effect, an air current is created in the detaching area 95 that is directed away from the opening roller 7, said air current being taken in from the duct formed by the opening roller 7 and the housing wall 75.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An open-end friction spinning unit arrangement comprising:

drivable friction surface means defining a yarn formation zone, fiber feeding and opening means including opening roller means surrounded by an opening roller housing means with discharge opening means for impurities and fiber feeding duct means extending from adjacent the opening roller means toward the yarn formation zone, suction device for applying suction forces for holding the fibers and forming yarn in the yarn formation zone, and compressed air duct means connected to the fiber feeding duct means in the area of the circumference of the opening roller means, said comperssed air duct means being aimed into the fiber feeding duct means, wherein the discharge opening means is arranged at a distance in front of the compressed air duct means with respect to the transport direction of the fibers.

2. An arrangement according to claim 1, wherein the compressed air duct means is arranged approximately tangentially with respect to the opening roller means as an extension of the fiber feeding duct means.

3. An arrangement according to claim 1, wherein the opening roller means is covered by wall piece means that is adapted to its contour and serves as a screen in the area between the discharge opening means and the compressed air duct means.

4. An arrangement according to claim 2, wherein the opening roller means is covered by wall piece means that is adapted to its contour and serves as a screen in the area between the discharge opening means and the compressed air duct means.

5. An arrangement according to claim 3, wherein the wall piece means is provided with at least one longitudinal groove extending in the axial direction of the opening roller means.

6. An arrangement according to claim 1, wherein the compressed air duct means is divided into several smaller ducts which with their own mouths lead into the fiber feeding duct means.

7. An arrangement according to claim 6, wherein the mouths of the ducts are located behind one another in the circumferential direction of the opening roller means.

8. An arrangement according to claim 6, wherein the mouths of the ducts each extend approximately over the operating width of the opening roller means.

9. An arrangement according to claim 7, wherein the mouths of the ducts each extend approximately over the operating width of the opening roller means.

10. An arrangement according to claim 6, wherein the mouths of the ducts are located behind one another in the axial direction of the opening roller means.

11. An arrangement according to claim 1, wherein the fiber feeding duct means is divided into at least two partial ducts, to which a separate compressed air duct of the compressed air duct means is in each case assigned.

12. An arrangement according to claim 7, wherein the fiber feeding duct means is divided into at least two partial ducts, to which a separate compressed air duct of the compressed air duct means is in each case assigned.

13. An arrangement according to claim 6, wherein the individual ducts have flow varying means for generating varying compressed air flows through the ducts.

14. An arrangement according to claim 1, including an excess pressure chamber which is connected to a compressed air source, compressed air duct means starting in said chamber.

15. An arrangement according to claim 14, wherein a compensating insert is arranged between the compressed air source and the compressed air duct means.

16. An arrangement according to claim 1, wherein the compressed air duct means is tangentially led past the opening roller means in such a way that the compressed air jet that is coming out is aimed approximately tangentially at the cylinder surface enclosing the points of a set of the opening roller means.

17. An arrangement according to claim 1, including a compressor having a suction inlet connected to the suction device means, compressed air being supplied to said compressed air duct means by said compressor.

18. A process for spinning yarn in an open-end friction spinning unit of the type comprising:

driveable friction surface means defining a yarn formation zone, fiber feeding and opening means including opening roller means surrounded by an opening roller housing means with discharge opening means for impurities and fiber feeding duct means extending from adjacent the opening roller means toward the yarn formation zone, suction device means for applying suction forces for holding the fibers and forming yarn in the yarn formation zone, yarn withdrawal means for withdrawing formed yarn from the yarn formation zone, and compressed air duct means connected to the fiber feeding duct means in the area of the circumference of the opening roller means, said process comprising:

feeding sliver to the opening roller means, opening said silver into individual fibers, feeding the fibers to the fiber feeding duct, applying compressed air into the fiber feeding duct means along the opening roller means while applying suction means to the yarn formation zone via the suction device so that the fibers are guided in an air stream formed at both the compressed air duct means and the suction device means, and spinning the fibers into a yarn in said yarn formation zone.

19. A process according to claim 18, including arranging the compressed air duct means approximately tangentially with respect to the opening roller means as an extension of the fiber feeding duct means.

20. A process to claim 19, including disposing the compressed air duct means tangentially past the opening roller means in such a way that the compressed air jet that is coming out is aimed approximately tangentially at the cylinder surface enclosing the points of a set of the opening roller means.

21. An arrangement according to claim 1, wherein the drivable friction surface means comprises a pair of adjacently arranged friction rollers drivable in the same rotational direction and said yarn formation zone comprises a yarn forming gap between the rollers.

22. A process according to claim 18, wherein the drivable friction surface means comprises a pair of adjacently arranged friction rollers drivable in the same rotational direction and said yarn formation zones comprises a yarn forming gap between the rollers.

* * * * *